US010317169B2

(12) United States Patent
McKendrick

(10) Patent No.: US 10,317,169 B2
(45) Date of Patent: Jun. 11, 2019

(54) HOLSTER TENSIONER DEVICE

(71) Applicant: Safariland, LLC, Jacksonville, FL (US)

(72) Inventor: Matthew McKendrick, Jacksonville, FL (US)

(73) Assignee: Safariland, LLC, Jacksonville, FL (US)

( * ) Notice: Subject to any disclaimer, the term of this patent is extended or adjusted under 35 U.S.C. 154(b) by 0 days.

(21) Appl. No.: 15/832,986

(22) Filed: Dec. 6, 2017

(65) Prior Publication Data

US 2018/0164072 A1 Jun. 14, 2018

Related U.S. Application Data

(60) Provisional application No. 62/434,141, filed on Dec. 14, 2016.

(51) Int. Cl.
*F41C 33/00* (2006.01)
*F41C 33/02* (2006.01)

(52) U.S. Cl.
CPC ..... *F41C 33/0263* (2013.01); *F41C 33/0209* (2013.01); *F41C 33/0236* (2013.01); *F41C 33/0272* (2013.01)

(58) Field of Classification Search
CPC ..... F41C 33/00; F41C 33/02; F41C 33/0209; F41A 17/00
USPC ..... 224/243, 245, 911
See application file for complete search history.

(56) References Cited

U.S. PATENT DOCUMENTS

| | | | | |
|---|---|---|---|---|
| 5,931,358 | A | 8/1999 | Rogers | |
| 5,944,239 | A | 8/1999 | Rogers et al. | |
| 7,258,259 | B1 * | 8/2007 | Owens | A45F 5/02 224/192 |
| 7,694,860 | B2 | 4/2010 | Clifton, Jr. | |
| 7,841,497 | B1 * | 11/2010 | Gregory | F41C 33/045 224/243 |
| 8,474,670 | B1 * | 7/2013 | Gregory | F41C 33/0263 224/243 |
| 8,602,275 | B1 * | 12/2013 | Kiger | F41C 33/0263 224/238 |
| 9,222,750 | B1 * | 12/2015 | Keepers | F41C 33/0209 |
| 9,322,612 | B2 | 4/2016 | Clifton, Jr. | |
| 2006/0157520 | A1 | 7/2006 | Clifton, Jr. | |
| 2007/0175935 | A1 | 8/2007 | Clifton, Jr. | |
| 2013/0306691 | A1 | 11/2013 | Baumann et al. | |

FOREIGN PATENT DOCUMENTS

FR 2963092 A1 1/2012

OTHER PUBLICATIONS

European Patent Application No. 17205735.8—Extended European Search Report dated Apr. 16, 2018.

* cited by examiner

*Primary Examiner* — Brian D Nash
(74) *Attorney, Agent, or Firm* — Kane Kessler, P.C.; Paul E. Szabo

(57) ABSTRACT

A holster for a handgun includes a holster body having a chamber for receiving the handgun. An adjustable and resilient tensioner is mounted on the holster body in a position to be engaged by a handgun in the chamber, the tensioner being operable to apply a resilient biasing force to the handgun in the chamber.

8 Claims, 5 Drawing Sheets

HOLSTER TENSIONER DEVICE

BACKGROUND OF THE INVENTION

A typical handgun holster includes a body portion defining a chamber having an opening. The handgun is inserted, muzzle first, through the opening into the chamber. The handgun is thereby received and supported in the body portion of the holster.

It is desirable for the handgun to be positioned and retained in the chamber, by means other than a tight fit of the handgun itself in the holster. To that end, some holsters incorporate a tensioning device. The tensioning device engages the handgun body portion inside the chamber, for example engaging the muzzle. The frictional engagement between the tensioning device and the handgun helps to position the handgun in the holster, and also helps to resist inadvertent movement of the handgun out of the holster.

Holsters with adjustable tensioning devices are known; these devices can be adjusted to control the amount of tension that is applied to the handgun. As one example, U.S. Pat. No. 7,694,560 discloses a handgun holster with an adjustable tensioning member that has a flexibly mounted end portion that can be pushed toward or away from the holster chamber by adjusting a set screw. This is a one-time setting of the starting position of the tensioning member. The tensioning member does not resiliently engage the handgun. As another example, U.S. Pat. No. 9,322,612 discloses a handgun holster with an adjustable tensioning member that is elongate and is suspended freely between its ends. The starting position of the tensioning member can be set with a screw. After the starting position is set, the tensioning member engages the handgun when in the chamber, but not resiliently. The tensioning member has a long, unsupported, central portion which may eventually weaken or fracture.

SUMMARY OF THE INVENTION in one embodiment, this invention relates to a holster for a handgun, the holster including a holster body having a chamber for receiving the handgun. A adjustable and resilient tensioner is mounted on the holster body in a position to be engaged by a handgun in the chamber, the tensioner being operable to apply a resilient biasing force to the handgun in the chamber.

BRIEF DESCRIPTION OF THE DRAWINGS

Further features of the invention will become apparent to one of ordinary skill in the art to which the invention pertains when reading the following description of embodiments of the invention together with the drawings, in which.

DESCRIPTION OF EMBODIMENTS OF THE INVENTION

Figure 1:
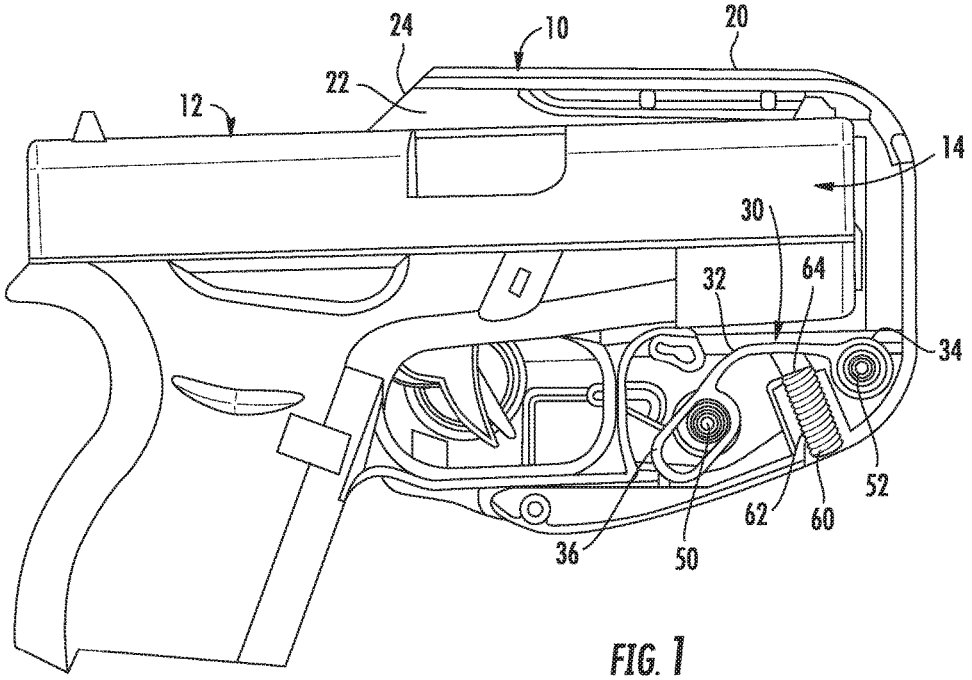
FIG. 1 is a side elevational view, partially cut away, of a holster including a tensioner in accordance with a first embodiment of the present invention, shown with a handgun inserted in the chamber of the holster, and showing the handgun out of engagement with the tensioner.
Figure 2:
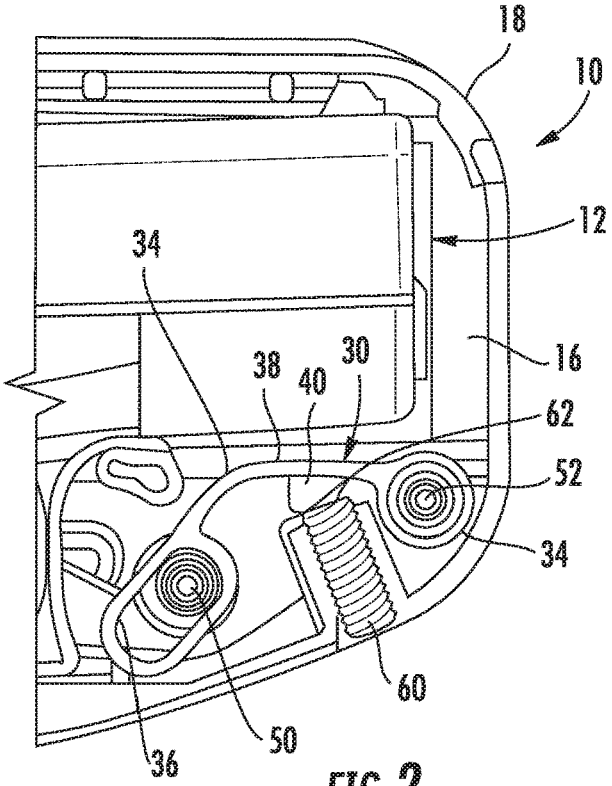
FIG. 2 is an enlargement of a portion of FIG. 1 including the tensioner.
Figure 3:
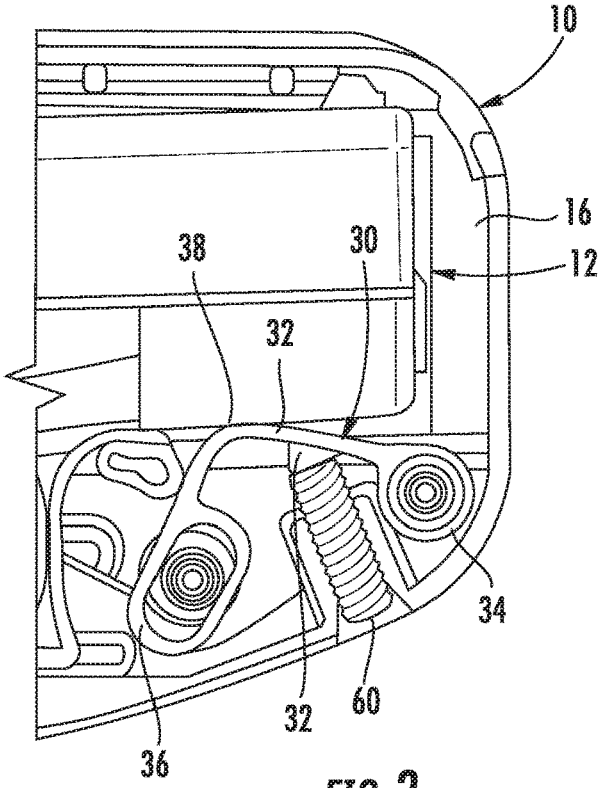
FIG. 3 is a view similar to FIG. 2 showing the handgun in a position in engagement with the tensioner.
Figure 4:
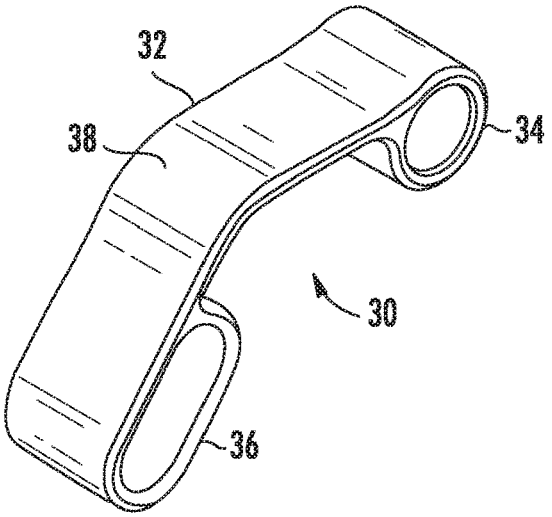
FIG. 4 is a perspective view of the tensioner alone, taken from the inside.
Figure 5:
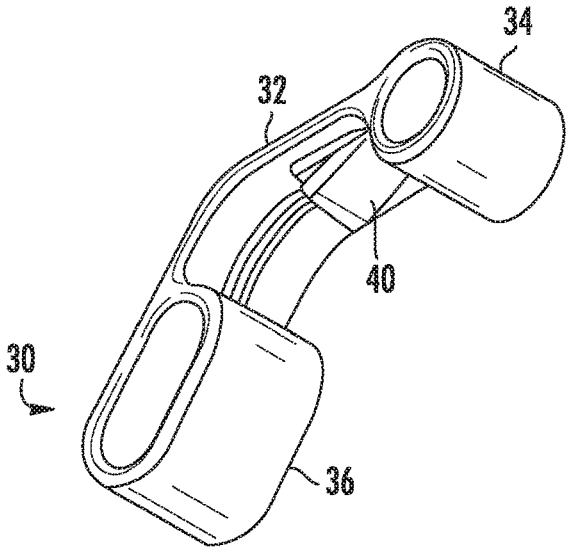
FIG. 5 is a perspective view of the tensioner alone, taken from the outside.
Figure 6:
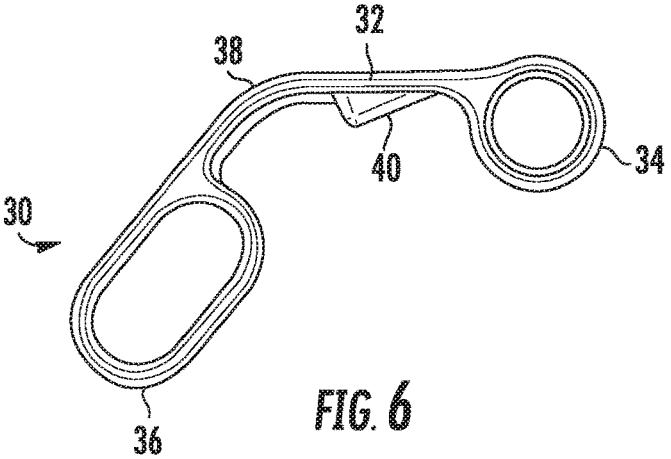
FIG. 6 is a side elevational view of the tensioner alone.
Figure 7:
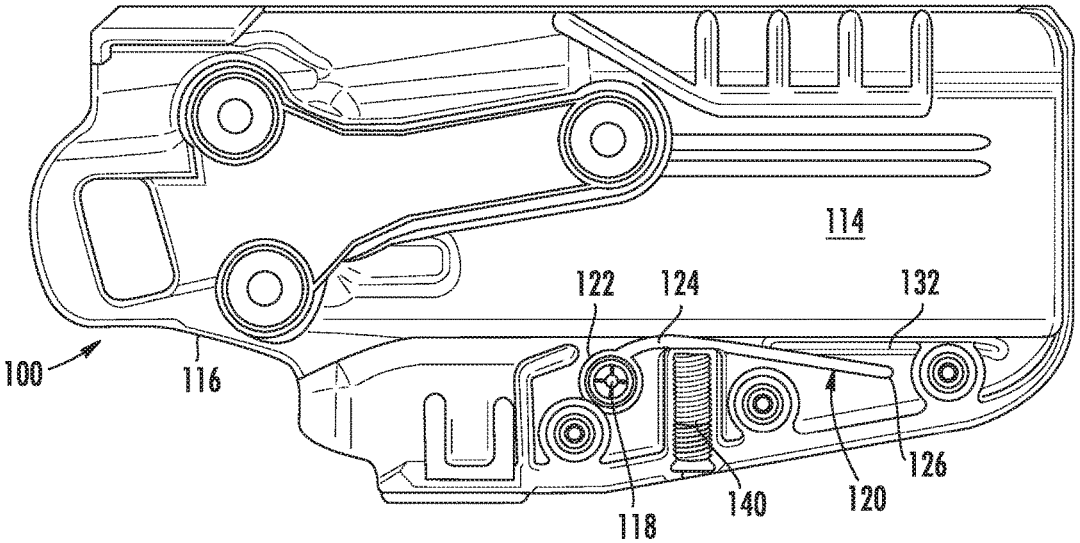
FIG. 7 is a side elevational view, partially cut away, of a holster including a tensioner in accordance with a second embodiment of the invention, shown with a handgun inserted in the chamber of the holster, and showing the handgun out of engagement with the tensioner.
Figure 8:
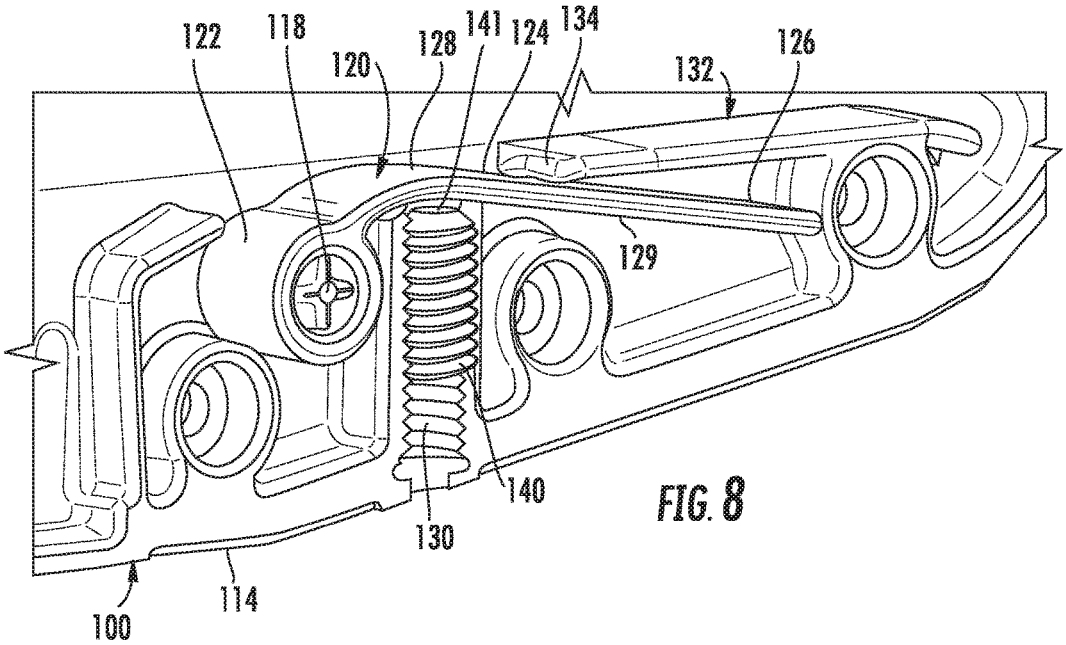
FIG. 8 is a perspective view of a portion of the holster of FIG. 7 including the tensioner.

FIGS. 1-6 illustrate a handgun holster 10 that is a first embodiment of the invention. The holster 10 is adapted to receive a handgun illustrated schematically at 12. The handgun 12 includes a muzzle 14.

The holster 10 (FIG. 1) includes a holster body 20 that defines an interior chamber 22 for receiving the handgun 12. The holster 10 has an opening 24 into the chamber 22 for allowing insertion of the handgun 12 into the holster.

It is desirable for the handgun 12 to be positioned and retained in the chamber 22 by means other than a tight fit of the handgun itself in the holster 10. To that end, the holster 10 includes a tensioner 30 mounted on the holster body 20 in a position to be engaged by the handgun 12 when the handgun is inserted in the chamber 22. The tensioner 30 is operable, as described below, to apply a resilient biasing force to the handgun 12 when the handgun is inserted in the chamber 22.

The tensioner 30 (FIGS. 4-6) is a stiff but resilient element, in this case made from plastic. The tensioner 30 has a generally V-shaped configuration including an elongate handgun engagement portion or central portion 32, extending between first and second end portions 34 and 36. The central portion 32 of the tensioner 30 has an inner side surface 38 that is presented toward the holster chamber 22, and an opposite outer side surface 40. In this embodiment, the central portion 32 is generally V-shaped, concave toward the outside (exterior) of the holster 10. The first end portion 34 of the tensioner 30 is formed as a hollow circular cylinder. The second end portion 36 of the tensioner 30 is formed as a hollow, oval-shaped ring.

The holster body 20 (FIGS. 1-3) includes two mounting bosses 50 and 52 for supporting the tensioner 30 on the holster body. Both mounting bosses 50 and 52 are cylindrical in configuration. The first end portion 34 of the tensioner 30 is closely fitted on the first boss 50, and is rotatable on the first boss without translational movement. The second end portion 36 of the tensioner 30 is fitted over and extends around the second boss 52. Because the second end portion 36 of the tensioner 30 is oval-shaped rather than simply circular, the second end portion of the tensioner is both (i) rotatable (pivotable) on the second boss 52, and (ii) slidable (translatable) along the second boss. These two degrees of freedom can be seen in a comparison of FIGS. 2 and 3.

When the tensioner 30 is mounted on the bosses 50 and 52 of the holster body 20, the inner side surface 38 (FIGS. 2 and 3) of the tensioner central portion 32 is presented toward the chamber 22 of the holster body. The location of the tensioner 30 in the holster 10 is such that inner side surface 38 of the tensioner central portion 32 is engageable by the muzzle 14 of the handgun 12 when the handgun is in the chamber 22.

The holster 10 includes a tensioner adjustment member 60 in the form of a set screw or adjustment screw (FIG. 1). The set screw 60 is threadedly engaged in an opening 62 in the holster body 20. The set screw 62 has an inner end portion or tip 64 adjacent to the outer side surface 40 of the tensioner central portion 32. The opposite outer end portion 66 of the set screw 60 is exposed on the exterior of the holster 10, to be engaged for manual engagement and rotation.

Rotation of the set screw 60 in the opening 62 of the holster body 20 results in movement of the set screw tip 64 toward and away from the chamber 22. The relative positions of the set screw 60 and the tensioner 30 are selected so that the tip 64 of the set screw can engage the outer side surface 40 of the central portion 32 of the tensioner 30. Rotation of the set screw inward in the holster 10 causes movement or positioning of the tensioner central portion 32 in a direction toward the chamber 22. Rotation of the set screw outward in the holster 10 pulls the screw tip 64 away from the chamber 22, allowing the tensioner central portion 32 to move or be positioned in a direction away from the chamber.

In operation, the position of the set screw and tensioner 30 can be set initially before insertion of the handgun 12. The handgun 12 is then inserted. The set screw is then rotated in the holster body 20 (FIG. 3) until it both engages the tensioner central portion 32 and pushes the inner side surface 38 against the handgun 12. The selected position of the tensioner 30 can be adjusted via the set screw 60 to provide the desired amount of biasing force.

When the handgun 12 is thereafter removed and re-inserted, the handgun engages the inner side surface 38 of the tensioner central portion 32. The tensioner central portion 32 has a large radius to provide a smooth engagement with the handgun 12 during insertion and removal of the handgun.

The force exerted on the tensioner 30 when the handgun 12 engages the tensioner central portion 32 produces only rotational movement of the tensioner first end portion 34 on the holster body 20, while at the same time producing both sliding and rotational movement of the tensioner second end portion 36 on the holster body 20. This ability of the tensioner second end portion 36 to slide, or translate, relative to the second mounting boss, means that the tensioner central portion 32 can resiliently deform (be pushed away from the chamber 22 by the handgun 12) even after its initial position is set via the set screw 60. Because of this resilience, the handgun 12 does not have to be perfectly aligned with the holster 10 when the handgun is inserted into the chamber 22, in order for the full effect of the tensioner 30 to be made available; rather, the resilient tensioner can adjust and reposition itself so as to both position the handgun properly and help to secure it in the holster.

Further, when the handgun 12 is in position in the holster chamber 22, and in engagement with the tensioner 30, the tensioner can be adjusted, because it is resilient. Specifically, by appropriate rotation of the set screw 60, the user can set the desired amount of force that the tensioner 30 exerts on the handgun 12. This adjustment affects the amount of force that is needed to remove the handgun 12 from the holster 10. This adjustment also affects the position of the handgun 12 in the holster 10.

FIGS. 7-10 illustrate a handgun holster 100 including a tensioner 120 that is a second embodiment of the invention. The holster 100 is adapted to receive a handgun 102, a muzzle of which is shown at 104 in FIGS. 9 and 10.

The holster 110 includes a chamber 114 defined by a holster body 116, for receiving at least the muzzle portion of the handgun 102. The holster body 116 has a single mounting boss 118 that is cylindrical in configuration.

The tensioner 120 is mounted on the holster body 116 in a position to be engaged by the handgun 102 when the handgun is inserted in the holster body. The tensioner 120 is operable, as described below, to apply a resilient biasing force to the handgun 102 when the handgun is inserted in the holster body.

Specifically, the tensioner 120 is shaped as a thin bar or finger with a hollow circular mounting portion 122 on one end. The tensioner 120 is configured to be stiff but resilient, and may be made from plastic. The tensioner 120 has a slightly curved, elongate central portion 124 that extends from the mounting portion 122. The opposite second end portion 126 of the tensioner is free, that is, simply terminates the elongate finger-like configuration of the tensioner, without any added material or connection.

The mounting portion 122 of the tensioner 120 is closely fitted on the boss 118, and is rotatable on the boss without translational movement. When the tensioner 120 is mounted on the holster body 116, a convex inner side surface 128 of the tensioner central portion 124 is presented toward the handgun 102. The location of the tensioner 120 in the holster 10 is selected so that the inner side surface 128 of the tensioner central portion 124 is engageable by a portion of the handgun 102, such as the muzzle 104, when the handgun is inserted in the holster body 116. The tensioner central portion 124 also has an opposite outer side surface 129 that is presented outward of the holster chamber 114.

Adjacent to the mounting boss 118 there is formed on the holster body 10 an internally threaded set screw opening 130. On the opposite side of the set screw opening 130, a bar 132 is formed on the holster body 116. The bar 132 has an end 134 that is positioned so that the set screw opening 130 is about midway between the mounting boss 118 and the bar end 134.

The holster 100 includes a tensioner adjustment member in the form of a set screw or adjustment screw 140 (FIG. 8), that is operable in the same manner as the set screw 60 of the first embodiment (FIGS. 1-6). The set screw 140 is threaded into the set screw opening 130 in the holster body portion. The set screw 140 has an inner tip 141 that is engageable with the tensioner 120 at a location just past the curved central portion 124 of the tensioner.

Figure 9:
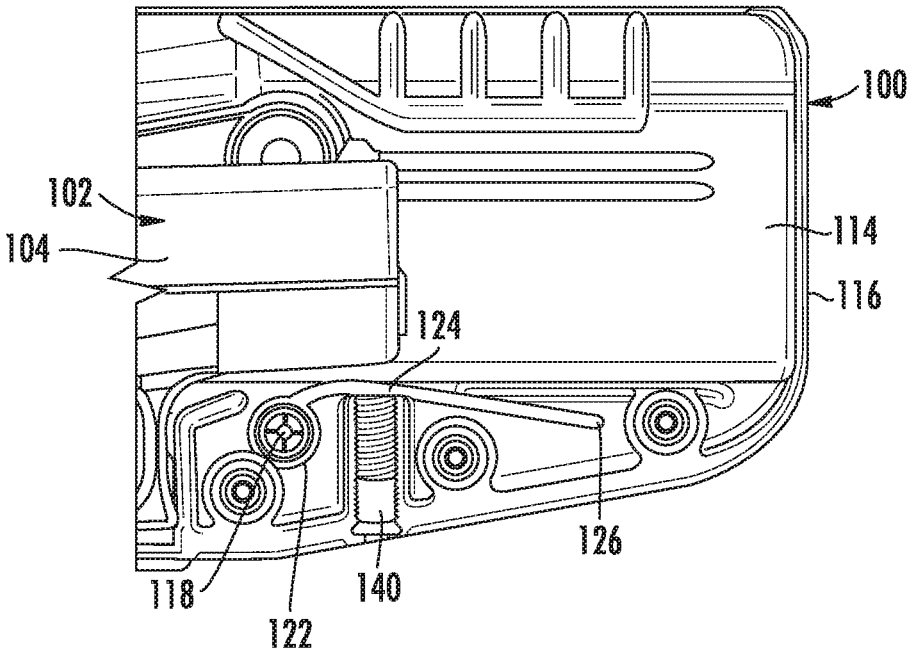
FIG. 9 is a side elevational view of the holster and tensioner of FIG. 7 and also showing a handgun inserted in the chamber of the holster, with the tensioner out of engagement with the handgun.
Figure 10:
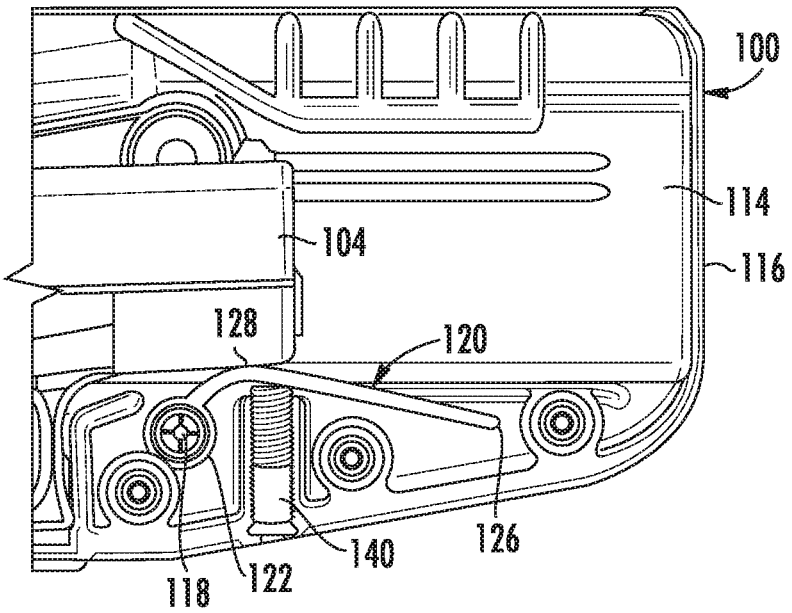
FIG. 10 is a view similar to FIG. 9 showing the tensioner in engagement with the handgun.

The relative positions of the set screw 140 and the tensioner 120 are selected so that the tip 141 of the set screw can engage the outer side surface 129 of the central portion 124 of the tensioner. Rotation of the set screw 140 inward in the holster 100 causes movement or positioning of the tensioner central portion 124 in a direction toward the holster chamber 114. When the set screw 140 is screwed in far enough, it pushes the tensioner 120 into engagement with the bar end 134 (FIGS. 9 and 10). Any further inward movement of the set screw 140 results in the tensioner 120 resiliently bending about the bar end 135 as a fulcrum. Rotation of the set screw 140 outward in the holster 10 pulls the screw tip 141 away from the holster chamber 116, allowing the tensioner central portion 124 to move or be positioned in a direction away from the holster chamber.

The force exerted on the tensioner 120 when the handgun 102 engages the tensioner central portion 124 produces rotational movement of the tensioner first end portion 122 on the mounting boss, while at the same time producing sliding movement of the tensioner's free second end portion 126 along the bar end 134 of the holster body 116. This ability of the tensioner second end portion 126 to slide, or translate, relative to the holster body 116, means that the tensioner central portion 124 can resiliently deform (be pushed outward from the holster body by the inserted handgun 102) even after its initial position is set via the set screw 140. Because of this resilience, the handgun 102 does not have to be perfectly aligned with the holster 10 when the handgun is inserted in the chamber 114, in order for the full effect of the tensioner 120 to be made available. Rather, the resilient tensioner 120 can adjust and reposition itself so as to both position the handgun 102 properly and help to secure it in the holster 100.

Further, when the handgun 102 is in position in the holster 100, in engagement with the tensioner 120, the tensioner can be adjusted, because it is resilient. Specifically, by appropriate rotation of the set screw 140, the user can set the desired amount of force that the tensioner 120 exerts on the handgun 102. This adjustment affects the amount of force that is needed to remove the handgun 102 from the holster 100. This adjustment also affects the position of the handgun 102 in the holster 100.

From the above description of the invention, those skilled in the art will perceive improvements, changes and modifications. Such improvements, changes and modifications within the skill of the art are intended to be covered by the appended claims.

The invention claimed is:

1. A holster for a handgun, the holster including: a holster body having a chamber for receiving the handgun; and an adjustable and resilient tensioner mounted on the holster body in a position to be engaged by a handgun in the chamber, the tensioner being operable to apply a resilient biasing force to the handgun in the chamber; and wherein the tensioner includes a resilient handgun engagement portion extending between first and second tensioner end portions, one of the first and second tensioner end portions being mounted on the holster body for rotational movement on the holster body, whereby force exerted on the handgun engagement portion by the handgun results in sliding movement of the second tensioner end portion on the holster body.

2. A handgun holster as set forth in claim 1 wherein the tensioner first end portion is mounted on the holster body for only rotational movement on the holster body, and the tensioner second end portion is mounted on the holster body for both sliding and rotational movement on the holster body.

3. A handgun holster as set forth in claim 2 wherein each one of the first and second end portions of the tensioner is formed as a closed loop that extends around a circular mounting boss on the holster body.

4. A Handgun holster as set forth in claim 3 wherein the tensioner second end portion is an oval shaped loop that extends around a circular mounting boss on the holster body.

5. A handgun holster as set forth in claim 1 wherein the tensioner first end portion is mounted on the holster body for only rotational movement on the holster body, and the tensioner second end portion is freely slidable along the holster body.

6. A handgun holster as set forth in claim 1, including means for setting an initial position of the tensioner handgun engagement portion relative to the chamber, the tensioner handgun engagement portion being resiliently deformable under force exerted by the handgun after the initial position is set.

7. A handgun holster as set forth in claim 6, wherein the means for setting is a set screw.

8. A handgun holster as set forth in claim 6 wherein:

the tensioner includes a resilient handgun engagement portion extending between first and second tensioner end portions, one of the first and second tensioner end portions being mounted on the holster body for rotational movement on the holster body, whereby force exerted on the handgun engagement portion by the handgun results in sliding movement of the second tensioner end portion on the holster body.

* * * * *